United States Patent [19]

Roland

[11] 4,348,052

[45] Sep. 7, 1982

[54] KNOCK DOWN CHAIR

[76] Inventor: Billy F. Roland, 37805 Maple Hill, Mt. Clemens, Mich. 48043

[21] Appl. No.: 125,961

[22] Filed: Feb. 29, 1980

[51] Int. Cl.[3] ..... A47C 4/03

[52] U.S. Cl. ..... 297/440; 297/133; 297/442; 297/450

[58] Field of Search ..... 297/440, 442, 444, 258, 297/272, 133, 450, 452, 445

[56] References Cited

U.S. PATENT DOCUMENTS

| | | | |
|---|---|---|---|
| 2,279,864 | 4/1942 | Eide | 297/442 X |
| 2,486,987 | 11/1949 | Scarlett | 297/442 X |
| 2,710,053 | 6/1955 | Hamilton | 297/440 |
| 2,723,788 | 11/1955 | Lund | 297/442 X |
| 3,527,497 | 9/1970 | Self | 297/442 |
| 3,845,988 | 11/1974 | Fleisch et al. | 297/440 |
| 3,870,366 | 3/1975 | Rogers | 297/440 |
| 4,062,589 | 12/1977 | Klein et al. | 297/450 |
| 4,091,746 | 5/1978 | Kimbrough | 297/440 X |
| 4,140,065 | 2/1979 | Chacon | 297/440 X |

FOREIGN PATENT DOCUMENTS

| | | | |
|---|---|---|---|
| 2900117 | 7/1979 | Fed. Rep. of Germany | 297/440 |
| 43917 | 3/1971 | Finland | 297/440 |

*Primary Examiner*—James T. McCall

*Attorney, Agent, or Firm*—Basile, Weintraub & Hanlon

[57] ABSTRACT

A knock down chair made from an assembly of interlocking planar members requiring no fasteners. The various members can be made from a single sheet of commercially available plywood and include first and second side members, a seat member, a pair of transverse seat support members, and a back member. The transverse seat support members are rotatingly interlocked to the side members, and the seat member is interlocked to the side members to hold the side members, the seat support members, and the seat in interlocking relationship. The back member is interlocked to the side members to complete the assembly.

4 Claims, 8 Drawing Figures

Fig-4
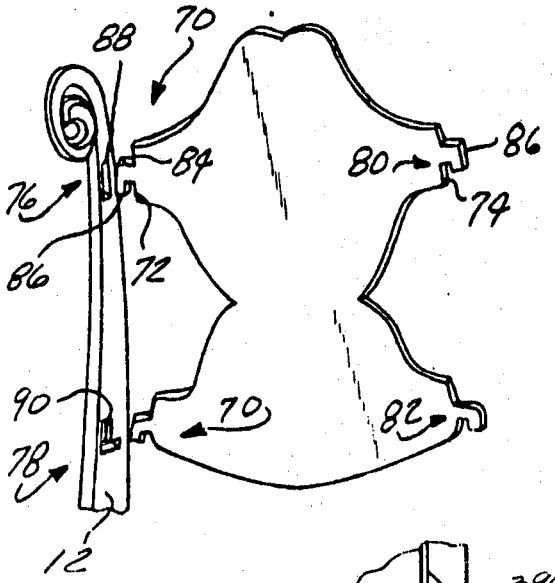
Fig-7
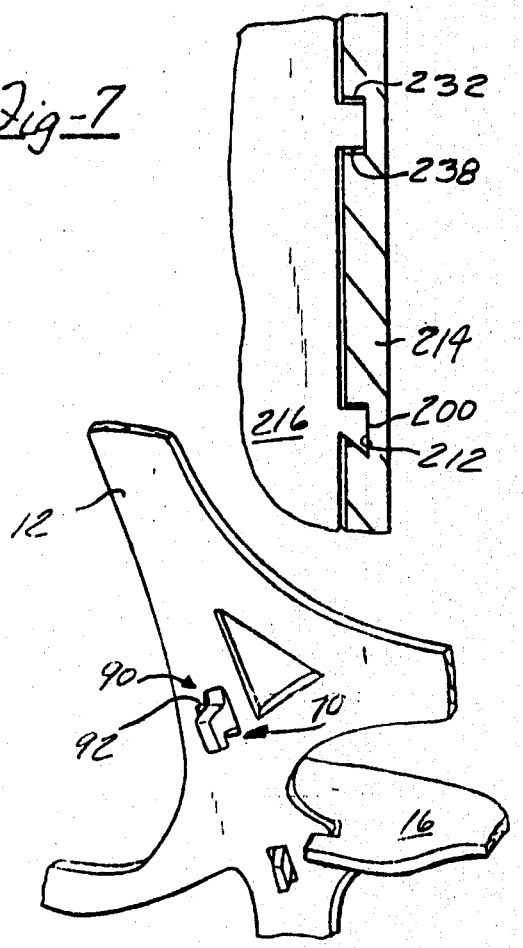
Fig-8
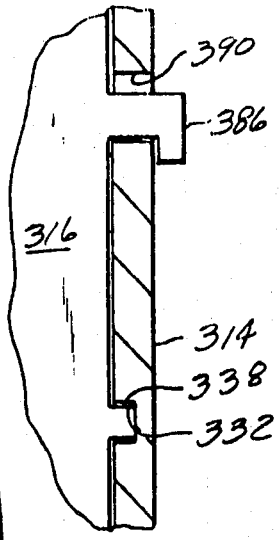
Fig-5
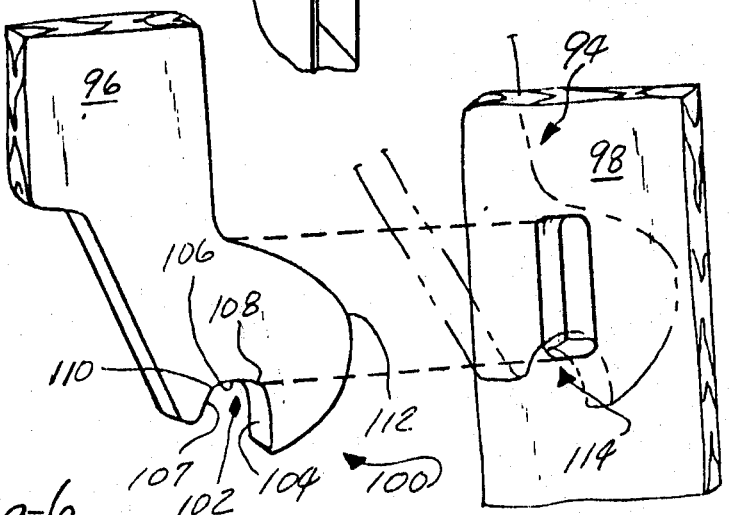
Fig-6

KNOCK DOWN CHAIR

BACKGROUND OF THE INVENTION

I. Field of the Invention

The present invention generally relates to the field of furniture, and in particular, the present invention is concerned with a chair having members formed from a single sheet of conventional plywood and assembled into interlocking relationship requiring no fasteners for the assembly. The chair can be readily disassembled and knocked down into a compact form for storage, transportation, or packaging.

II. Description of the Prior Art

Furniture of the knock down type that may be readily disassembled for storage and/or transportation or packaging has long been known. Usually the knock down furniture in the prior art employs fasteners of various types including threaded fasteners, dowels, or wedges to align and join the various parts into a completed assembly. Examples of knock down furniture using dowels, threaded fasteners, wedges, or the like in the prior art are disclosed in U.S. Pat Nos. 3,845,988; 3,870,366; and 4,140,065. U.S. Pat. No. 4,091,746 discloses a knock down article of furniture comprising components joined by tongue and groove and dovetail joints enabling the individual components to be merely pressed together to form the complete furniture article. These patents are relevant to the applicant's invention in that they represent the closest prior art for assembling knock down furniture.

SUMMARY OF THE INVENTION

The present invention, which will be described in greater detail hereinafter, comprises a knock down chair made from an assembly of interlocking planar members requiring no fasteners, wedges, dowels, or other devices to assemble various components of the chair into an interlocking assembly. The knock down chair of the present invention comprises a first side member and a second side member; a seat member; a pair of transverse seat support members; and a back member, with the various members cojoined into an interlocking assembly requiring no fasteners.

The pair of transverse seat support members are rotatingly locked to the first and second side members by a pair of opposed rotatingly engageable hook flanges integral with the opposed side members. Each rotatingly engageable hook flange is rotatingly and snugly engageable with a corresponding first rectangular opening formed in each of the first and second side members. A first pair of opposed transverse flanges spaced above the pair of opposed hook flanges are integral with the transverse seat support members and are aligned and snugly engageable with a second rectangular opening formed in the first and second side members. An access opening formed in the side members is configured to accommodate a pair of opposed side member engaging openings formed along opposed outer edges of the seat member. When the opposed side member engaging openings of the seat are engaged with the side member, the pair of transverse seat support members, the first and second side members, and the seat member are in interlocking engagement.

The back member is secured to the first and second side members by a first pair of spaced apart hook flanges disposed along a first side edge of the back member and a second pair of spaced apart hook flanges disposed along a second side edge of the back member. An upper opening and a lower opening formed in the first and second side members are aligned and snugly engageable with a corresponding pair of spaced apart hook flanges which are employed to interlockingly secure the back member to the first and second side members.

It is therefore a primary object of the present invention to provide a new and improved knock down chair.

It is a further object of the present invention to provide such a knock down chair which requires no fasteners for its assembly.

It is yet another object of the present invention to provide a new and improved knock down chair having components of a planar configuration that can be formed from a standard sized sheet of plywood.

It is yet a further object of the present invention to provide a new and improved knock down chair having interlocking joints arranged to prevent an accidental disassembly of the chair.

Further objects, advantages, and applications of the present invention will become apparent to those skilled in the art of knock down furniture when the accompanying description of one example of the best mode contemplated for practicing the invention is read in conjunction with the accompanying drawing.

BRIEF DESCRIPTION OF THE DRAWING

In the drawing, like reference numbers refer to like parts throughout the several views, and wherein:

FIG. 4 illustrates a perspective view of the hook flange of the back member;

FIG. 5 illustrates a perspective view of the lower opening formed in the side member;

FIG. 6 illustrates a perspective view of a joint for rotatingly interlocking a pair of perpendicular walls;

FIG. 7 illustrates a cross section of an alternate form of rotating interlocking joints; and FIG. 8 illustrates a cross section of an alternate form of interlocking hook joint.

DESCRIPTION OF THE PREFERRED EMBODIMENT

Figure 1:
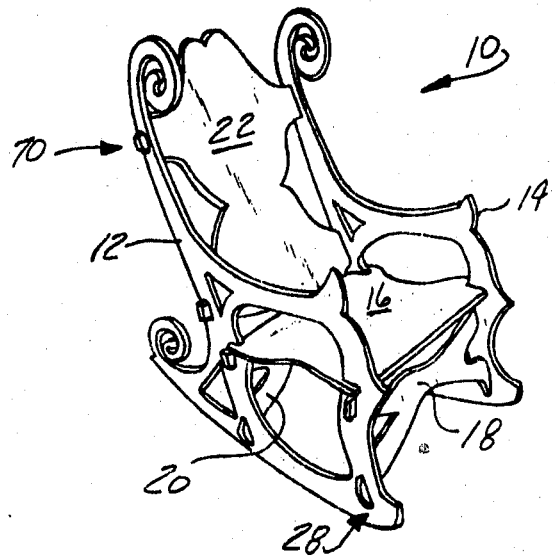
FIG. 1 illustrates a perspective view of the chair of the present invention.

Referring now to the drawing and in particular FIG. 1, there is illustrated at 10 one example of the present invention in the form of a knock down rocking chair. The knock down chair 10 is adapted to be made from an assembly of interlocking planar members requiring no fasteners to be assembled and includes a first side member 12 and a second side member 14; a seat member 16; a pair of transverse seat support members 18,20 rotatingly interlocked to the side members 12 and 14; and a back member 22 interlockingly engaged with the side members 12,14.

Figure 2:
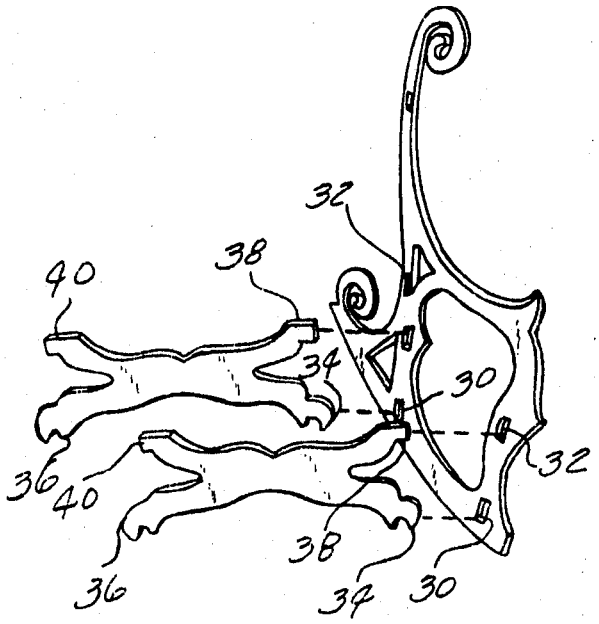
FIG. 2 illustrates a perspective view of the rotatingly engageable hook flanges of the present invention for joining the transverse seat support members to the side members.

A first locking means 28 is provided for rotatingly locking the transverse seat support members 18,20 to the first and second side members 12,14. The means 28 comprises a first pair of spaced apart rectangular openings 30 (FIG. 2) formed in the first and second side members 12,14 proximate a lower edge thereof, and a second pair of spaced apart rectangular openings 32 spaced above the first pair of rectangular openings 30. A pair of opposed rotatingly engageable hook flanges 34,36 are formed at an outer lower portion of each transverse seat support member 18,20 with each rotatingly engageable hook flange being rotatingly and snugly engageable with a corresponding first rectangular opening 30. A first pair of opposed transverse flanges 38,40 spaced above the pair of opposed rotatingly engageable hook flanges 34,36 and are alignable and are snugly engageable with the corresponding second rectangular openings 32. When the hook flanges 34,36 and the opposed transverse flanges 38,40 are engaged with the first and second rectangular openings, each transverse seat support member 18,20 is interlocked with its corresponding side member 12,14 and the side members are spaced apart and parallel in an upright position.

Figure 3:
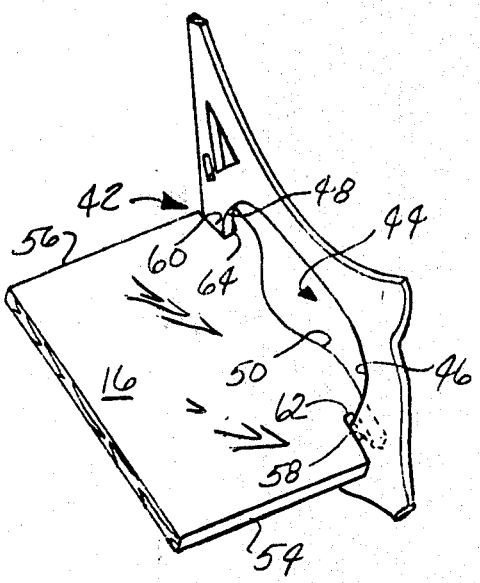
FIG. 3 illustrates a perspective view of the seat member joined to a side member.

A second locking means 42 is provided for securing the seat member 16 to the first and second side members 12,14 in an interlocking relationship which prevents rotation of the side members relative to the transverse seat support members and a resulting disengagement of the side members from the transverse seat support members. The second locking means 42 comprises (FIG. 3) an access opening 44 having opposed front and rear edges 46,48 formed in the first and second side members 12,14. The seat member 16 includes opposed outer edges 50,52, a forward edge 54 and a rearward edge 56. A pair of opposed side member engaging openings 58,60 are provided having open ends at the forward and rearward edges 54,56, respectively. The opposed openings 58,60 are formed inward from each of the opposed outer edges 50,52 and are snugly engageable with the first and second side members 12,14. Each side member engaging opening 58,60 includes an opening inner edge 62,64 abutting an opposed edge of the access opening 44. When the side member engaging openings 58,60 are engaged with the side members 12,14 the seat 16 is supported by the transverse seat support members 18,20 and the side members 12,14 are held in a spaced apart parallel relationship with the seat 16 preventing rotation of the side members relative to the transverse seat support members and a resulting disengagement of the side members from the transverse seat support members.

A third locking means 70 is provided for securing the back member 22 to the first and second side members 12,14 as illustrated in FIGS. 4 and 5. The back member 22 includes a first side edge 72 and a second side edge 74, and the third locking means 70 comprises a first pair of spaced hook flanges 76,78 disposed along the first side edge 72, and a second pair of spaced hook flanges 80,82 disposed along the second side edge 74. The first and second pairs of hook flanges comprise an upper portion 84 projecting outward and integral with its corresponding side edge, and an outer portion 86 extending downward from and integral with the upper portion spaced outward from its corresponding side edge. An upper opening 88 and a lower opening 90 are formed in each of the first and second side members aligned with and snugly engageable with a corresponding pair of spaced hook flanges. The lower opening 90 includes a rearward extending opening 92 in communication with the lower opening and positioned at a lower end thereof configured to snugly engage the hook flange upper portion 84. When the hook flange outer portion 86 has engaged the lower opening 90 it is then displaced downward to align the upper portion 84 with the rearward extending opening 92. The upper portion 84 is then displaced rearward to snugly engage the upper portion in the rearward extending opening interlocking the back member and its corresponding side member.

A joint 94 for rotatingly interlocking a first wall 96 intersecting with a second wall 98 may be employed as illustrated in FIG. 6 of the drawing. The joint 94 comprises a rotatable hook member 100 projecting from the first wall 96 and including a recess 102 having an upward extending outer wall 104, a top wall 106 perpendicular to the outer wall extending inward a distance, and an inner wall 107 extending inward and downward from the top wall. A first corner 108 is defined by an intersection of the outer wall 104 and the top wall 106, and a second corner 110 is defined by an intersection of the top wall 106 and the inner wall 107. An arcuate outside edge 112 defines an outer end of the hook member 100 and comprises an arc of constant radius having a center proximate the first corner beginning at a lower end of the outside edge and extending upward in an arcuate manner to a point vertically above the second corner 110. A hook member engaging opening 114 is formed in the second wall 98 having a width to snugly engage the rotatable hook member and a height proximate the radius of the arcuate outside edge 112. The first wall 96 and the second wall 98 are rotatingly interlocked by inserting the rotatable hook member 100 into the hook member engaging opening 114 and rotating the first wall about the center.

Another form of a rotating interlocking joint for joining a transverse seat support member 216 to a side member 214 is illustrated in FIG. 7. A blind hook flange 200 is engageable with a complementary blind aperture 212 and a blind transverse flange 238 is engageable with a complementary upper blind aperture 232 to secure the member 216 to the member 214. It is obvious to the skilled artisan that a pair of spaced blind transverse flanges 238 could also be employed to engage a pair of blind apertures 232.

FIG. 8 illustrates another form of interlocking joint that may be employed to interlock a member 316 to a side member 314 employing a hook joint 386 engaging an aperture 390. A blind lower flange 338 is engageable with a complementary blind lower aperture 332 to secure member 316 to member 314.

The various members which comprise the rocking chair 10 may be conveniently cut from a single sheet of commercially available plywood. In this manner the rocking chair 10 can be produced in a very economical low cost manner.

It can thus be seen that the present invention has provided a new and improved knock down rocking chair wherein a chair can be formed from components cut from a single sheet of commercially available plywood. It can be readily ascertained by a person skilled in the art to which this invention pertains, that a rocking chair can be very economically produced by employing the teachings of the present invention with the generation of very little waste material.

It should be understood by those skilled in the art of knock down furniture that other forms of the applicant's invention may be had, all coming within the spirit of the invention and the scope of the appended claims.

Having thus described my invention what I claim is:

1. A knock down chair made from an assembly of interlocking planar members requiring no fasteners comprising:

a first side member and a second side member;

a seat member;

a pair of transverse seat support members;

a back member having a first side edge and a second side edge;

a first locking means for rotatingly locking the transverse seat support members to the first and second side members;

a second locking means comprising a pair of opposed forwardly and rearwardly projecting hook means for securing the seat member to and preventing transverse movement of the rearward and forward portions of the first and second side members; and a third locking means for securing the back member to the first and second side members.

2. The knock down chair as defined in claim 1 wherein the first locking means for rotatingly locking the transverse seat support members to the first and second side members comprises:

a first pair of spaced apart rectangular openings formed proximate a lower edge of the first and second side members;

a second pair of spaced apart rectangular openings formed in the first and second side members spaced above the first pair of rectangular openings;

a pair of opposed rotatingly engageable hook flanges formed at an outer lower portion of each transverse seat support member, each rotatingly engageable hook flange being rotatingly and snugly engageable with a corresponding first rectangular opening;

a first pair of opposed transverse flanges spaced above the pair of opposed rotatingly engageable hook flanges, aligned and snugly engageable with a corresponding second rectangular opening; and wherein when the hook flange and the transverse flange are engaged with the first and second rectangular openings, the transverse seat support is interlocked with its corresponding side members.

3. The knock down chair as defined in claim 2 wherein the second locking means for securing the seat member to the first and second side members comprises:

an access opening including opposed front and rear edges formed in the first and second side members;

the seat member comprising opposed outer edges, a forward edge, a rearward edge, a pair of opposed side member engaging openings open at the forward and rearward edges respectively formed inward from each of the opposed outer edges and being snugly engageable with first and second side members, each side member engaging opening including an opening inner edge abutting an opposed edge of the access opening; and wherein when the side member engaging openings are engaged with the side members the seat is supported by the transverse seat support members.

4. The knock down chair as defined in claim 1 wherein the third locking means for securing the back member to the first and second side members comprises:

a first pair of spaced apart hook flanges disposed along the first side edge;

a second pair of spaced apart hook flanges disposed along the second side edge;

the first and second pairs of hook flanges comprising an upper portion projecting outward from and integral with its corresponding side edge, an outer portion extending downward from and integral with the upper portion spaced outward from its corresponding side edge;

an upper opening and a lower opening formed in the first and second side members aligned and snugly engageable with a corresponding pair of spaced apart hook flanges;

the lower opening including a rearward extending opening in communication with the lower opening positioned at a lower end thereof and configured to snugly engage the hook flange upper portion; and wherein when the hook flange outer portion has engaged the lower opening it is then displaced downward aligning the upper portion with the rearward extending opening then displaced rearward snugly engaging the upper portion in the rearward extending opening to interlock the back member and its corresponding side member.

* * * * *